US010485364B2

(12) United States Patent
Rivers

(10) Patent No.: US 10,485,364 B2
(45) Date of Patent: Nov. 26, 2019

(54) DISH COVERING ASSEMBLY

(71) Applicant: Charmaine Rivers, Houston, TX (US)

(72) Inventor: Charmaine Rivers, Houston, TX (US)

( * ) Notice: Subject to any disclaimer, the term of this patent is extended or adjusted under 35 U.S.C. 154(b) by 164 days.

(21) Appl. No.: 15/678,241

(22) Filed: Aug. 16, 2017

(65) Prior Publication Data

US 2019/0053651 A1 Feb. 21, 2019

(51) Int. Cl.

| | |
|---|---|
| ***A47G 19/26*** | (2006.01) |
| ***B65D 43/16*** | (2006.01) |
| ***B65D 25/54*** | (2006.01) |
| ***B65D 51/24*** | (2006.01) |
| ***B65D 25/28*** | (2006.01) |

(52) U.S. Cl.

CPC ..... *A47G 19/26* (2013.01); *B65D 25/2802* (2013.01); *B65D 25/54* (2013.01); *B65D 43/163* (2013.01); *B65D 51/24* (2013.01)

(58) Field of Classification Search

USPC ..... 220/254.3, 377

See application file for complete search history.

(56) References Cited

U.S. PATENT DOCUMENTS

| | | | | |
|---|---|---|---|---|
| 1,894,575 | A * | 1/1933 | Sherman | B65D 43/161 220/254.3 |
| 3,130,651 | A * | 4/1964 | Werner | E02D 29/14 16/267 |
| D250,448 | S | 12/1978 | Boldt et al. | |
| 5,111,956 | A | 5/1992 | Jow | |
| 5,118,001 | A * | 6/1992 | Gambill | H02B 1/06 220/377 |
| 5,318,811 | A | 6/1994 | Nissel | |
| 5,327,682 | A * | 7/1994 | Holtz | E04F 19/08 16/254 |
| 5,775,535 | A | 7/1998 | Vercellone et al. | |
| 6,640,798 | B2 | 11/2003 | Anh | |
| 6,872,920 | B2 | 3/2005 | Haber | |
| 7,339,140 | B2 | 3/2008 | Tidey | |
| 2005/0150395 | A1 | 7/2005 | Olekaibe et al. | |
| 2011/0219695 | A1 * | 9/2011 | Ivasiv | E05C 3/042 49/394 |

* cited by examiner

*Primary Examiner* — James N Smalley

(57) ABSTRACT

A dish covering assembly for protecting contents of a dish includes a shell. The shell has a top that is closed and a bottom that is open. The bottom is configured to insert a dish, such as a chafing pan, into the shell to couple the shell to the dish to cover the dish. A penetration is positioned through the top of the shell. A lid is hingedly coupled to the top of the shell and is selectively couplable to the shell to close the penetration. The lid and the shell are substantially transparent. The lid is positioned to pivot to an open configuration to allow access to the contents of the dish through the penetration. The lid also is positioned pivot to a closed configuration so that the shell and the lid are configured to protect the contents of the dish, such as from insects, germs, and temperature changes.

10 Claims, 3 Drawing Sheets

DISH COVERING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art including Information Disclosed Under 37 CFR 1.97 and 1.98

The disclosure and prior art relates to covering assemblies and more particularly pertains to a new covering assembly for protecting contents of a dish.

BRIEF SUMMARY OF THE INVENTION

An embodiment of the disclosure meets the needs presented above by generally comprising a shell. The shell has a top that is closed and a bottom that is open. The bottom is configured to insert a dish, such as a chafing pan, into the shell to couple the shell to the dish to cover the dish. A penetration is positioned through the top of the shell. A lid is hingedly coupled to the top of the shell and is selectively couplable to the shell to close the penetration. The lid and the shell are substantially transparent. The lid is positioned to pivot to an open configuration to allow access to the contents of the dish through the penetration. The lid also is positioned pivot to a closed configuration so that the shell and the lid are configured to protect the contents of the dish, such as from insects, germs, and temperature changes.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
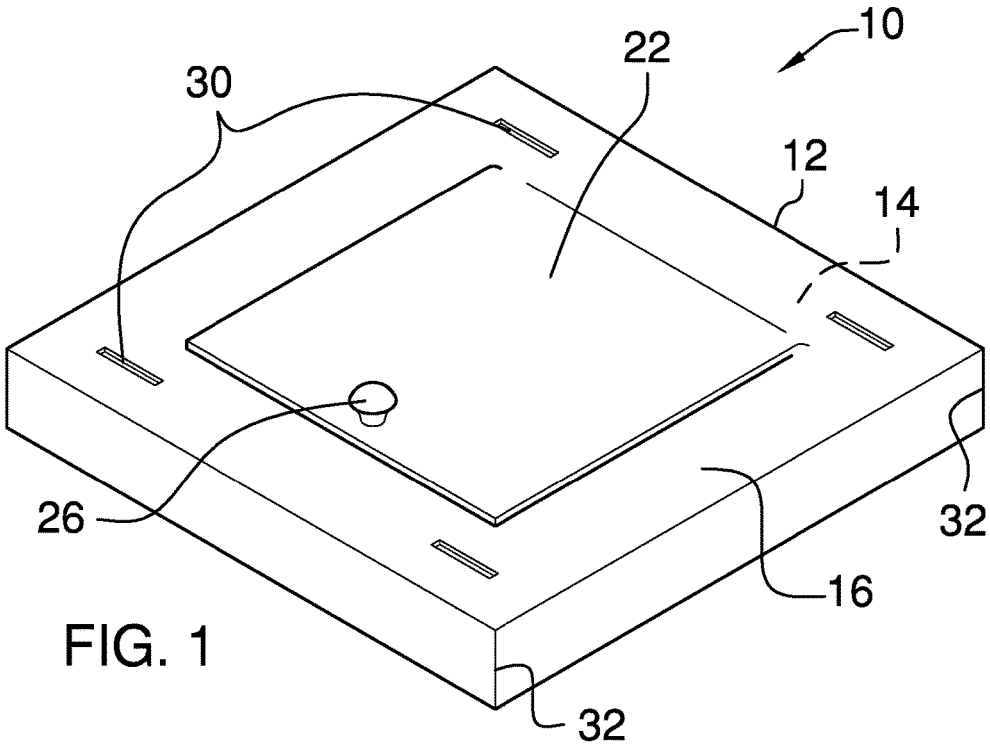
FIG. 1 is an isometric perspective view of a dish covering assembly according to an embodiment of the disclosure.
Figure 2:
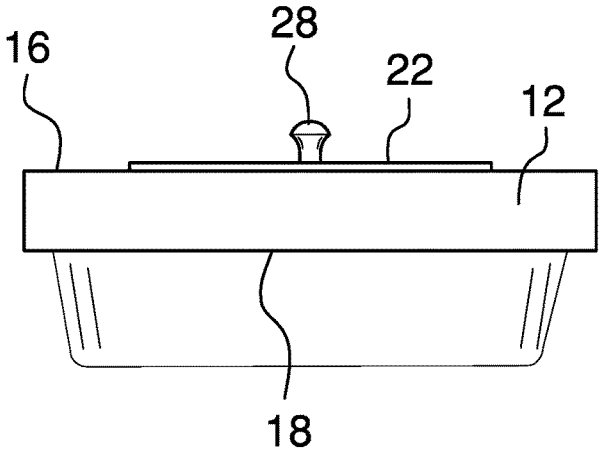
FIG. 2 is a side view of an embodiment of the disclosure.
Figure 3:
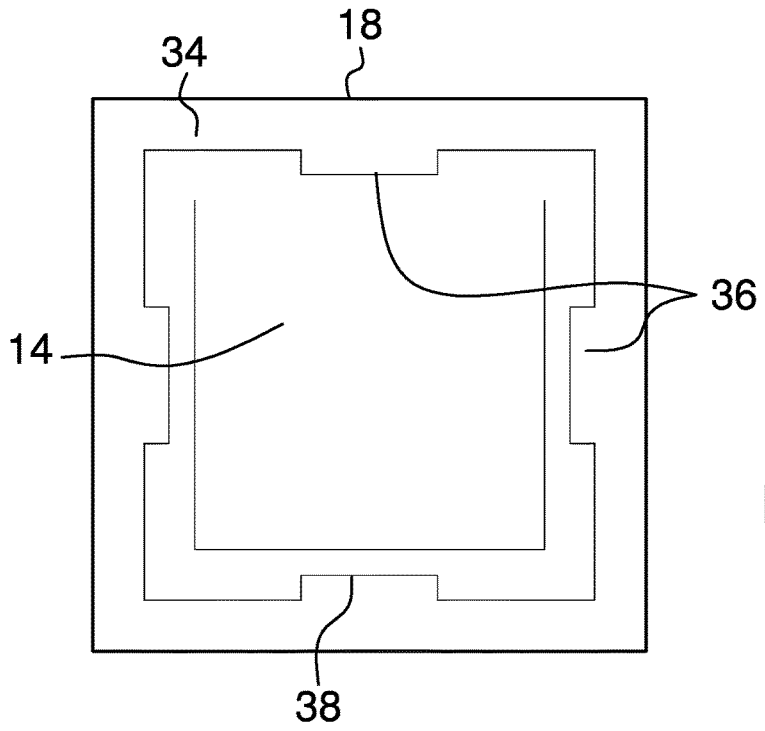
FIG. 3 is a bottom view of an embodiment of the disclosure.
Figure 4:
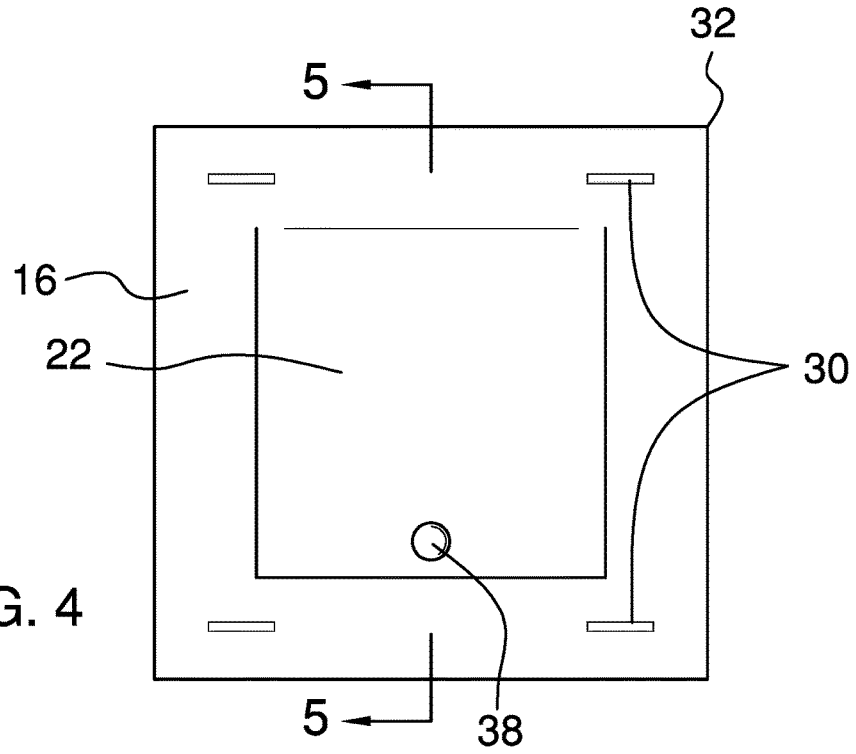
FIG. 4 is a top view of an embodiment of the disclosure.
Figure 5:
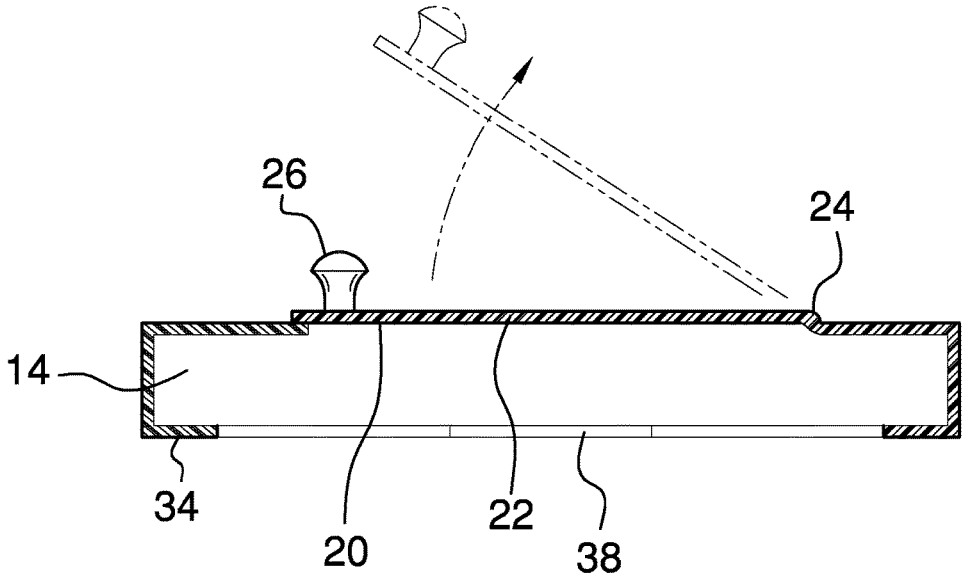
FIG. 5 is a cross-sectional view of an embodiment of the disclosure.

With reference now to the drawings, and in particular to FIGS. 1 through 5 thereof, a new covering assembly embodying the principles and concepts of an embodiment of the disclosure and generally designated by the reference numeral 10 will be described.

As best illustrated in FIGS. 1 through 5, the dish covering assembly 10 generally comprises a shell 12 that defines an interior space 14. The shell 12 is substantially transparent. The shell 12 has a top 16 that is closed and a bottom 18 that is open. The bottom 18 is configured to insert a dish, such as a chafing pan, into the interior space 14 to couple the shell 12 to the dish. The shell 12 covers the dish to protect contents of the dish, such as from insects, germs, and temperature changes. In one embodiment, the shell 12 is substantially rectangularly box shaped. In another embodiment, the top 16 and the bottom 18 of the shell 12 are squarely shaped.

A penetration 20 is positioned through the top 16 of the shell 12. In one embodiment, the penetration 20 is squarely shaped. A lid 22 is hingedly coupled to the top 16 of the shell 12. The lid 22 is complementary to the penetration 20. The lid 22 is substantially transparent. The lid 22 is selectively couplable to the shell 12 to close the penetration 20. The lid 22 is positioned to pivot to an open configuration to allow access to the contents of the dish through the penetration 20. The lid 22 also is positioned to pivot to a closed configuration to close the penetration 20 to protect the contents of the dish, such as from the insects, the germs, and the temperature changes.

At least one hinge 24 is coupled to and extends between the lid 22 and the shell 12. A handle 26 is coupled to the lid 22. The handle 26 is opposingly positioned relative to the at least one hinge 24. The handle 26 is configured to be grasped in a hand of a user to selectively motivate the lid 22 between the open configuration and the closed configuration to open and close the penetration 20. In one embodiment, the handle 26 comprises a knob 28.

A plurality of slits 30 is positioned in the shell 12. The slits 30 are configured to vent the dish. In one embodiment, the plurality of slits 30 comprises four slits 30 that are positioned singly in the top 16 proximate to each corner edge 32 of the shell 12.

A lip 34 is coupled to the shell 12 and extends inwardly from the bottom 18. A plurality of couplers 36 is coupled to the lip 34. The couplers 36 are configured to couple to the dish to couple the shell 12 to the dish. In one embodiment, each coupler 36 comprises a tab 38 that is coupled to and extends from the lip 34. The tabs 38 are resilient. The tabs 38 are configured to bend when contacting a rim of the dish and to rebound so that the tabs 38 are positioned below the rim to couple the shell 12 to the dish. In another embodiment, the plurality of couplers 36 comprises four couplers 36 that are positioned singly between and substantially equally distant from adjacent corner edges 32 of the shell 12.

In use, the tabs 38 that are positioned on the lip 34 are configured to bend when contacting the rim of the dish and to rebound so that the tabs 38 are positioned below the rim to couple the shell 12 to the dish. The slits 30 that positioned in the shell 12 are configured to vent the dish. The knob 28 that is positioned on the lid 22 is configured to be grasped in the hand of the user to selectively motivate the lid 22 between the open configuration, to allow access to the contents of the dish through the penetration 20, and the closed configuration, to close the penetration 20. The lid 22 in the closed configuration and the shell 12 protect the contents of the dish, such as from the insects, the germs, and the temperature changes.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A dish covering assembly comprising:

a shell defining an interior space, said shell being substantially transparent, said shell having a top and a bottom, said bottom being open such that said bottom is configured for inserting a dish, such as a chafing pan, into said interior space for coupling said shell to the dish for covering the dish for protecting contents of the dish, such as from insects, germs, and temperature changes, said shell being substantially rectangularly box shaped;

a penetration positioned through said top of said shell;

a lid hingedly coupled to said top of said shell, said lid being complementary to said penetration, said lid being substantially transparent, said lid being selectively couplable to said shell for closing said penetration;

wherein said lid is positioned on said shell such that said lid is positioned for pivoting to an open configuration for accessing the contents of the dish through said penetration and for pivoting to a closed configuration for closing said penetration for protecting the contents of the dish, such as from the insects, the germs, and the temperature changes; and a plurality of slits positioned in said shell, wherein said slits are positioned in said shell such that said slits are configured for venting the dish.

2. The assembly of claim 1, further including said top and said bottom of said shell being squarely shaped.

3. The assembly of claim 1, further including said penetration being squarely shaped.

4. The assembly of claim 1, further comprising:

at least one hinge coupled to and extending between said lid and said shell;

a handle coupled to said lid, said handle being opposingly positioned relative to said at least one hinge, wherein said handle is positioned on said lid such that said handle is configured for grasping in a hand of a user for selectively motivating said lid between the open configuration and the closed configuration for opening and closing said penetration.

5. The assembly of claim 4, further including said handle comprising a knob.

6. The assembly of claim 1, further including said plurality of slits comprising four said slits positioned singly in said top proximate to each corner edge of said shell.

7. A dish covering assembly comprising:

a shell defining an interior space, said shell being substantially transparent, said shell having a top and a bottom, said bottom being open such that said bottom is configured for inserting a dish, such as a chafing pan, into said interior space for coupling said shell to the dish for covering the dish for protecting contents of the dish, such as from insects, germs, and temperature changes, said shell being substantially rectangularly box shaped;

a penetration positioned through said top of said shell;

a lid hingedly coupled to said top of said shell, said lid being complementary to said penetration, said lid being substantially transparent, said lid being selectively couplable to said shell for closing said penetration;

wherein said lid is positioned on said shell such that said lid is positioned for pivoting to an open configuration for accessing the contents of the dish through said penetration and for pivoting to a closed configuration for closing said penetration for protecting the contents of the dish, such as from the insects, the germs, and the temperature changes;

a lip coupled to said shell and extending inwardly from said bottom;

a plurality of couplers coupled to said lip, said couplers being configured for coupling to the dish for coupling said shell to the dish; and wherein said couplers are positioned on said lip such that said couplers are configured for coupling to the dish for coupling said shell to the dish.

8. The assembly of claim 7, further including each said coupler comprising a tab coupled to and extending from said lip, said tabs being resilient, wherein said tabs are positioned on said lip such that said tabs are configured for bending when contacting a rim of the dish and for rebounding such that said tabs are positioned below the rim for coupling said shell to the dish.

9. The assembly of claim 7, further including said plurality of couplers comprising four said couplers positioned singly between and substantially equally distant from adjacent corner edges of said shell.

10. A dish covering assembly comprising:

a shell defining an interior space, said shell being substantially transparent, said shell having a top and a bottom, said bottom being open such that said bottom is configured for inserting a dish, such as a chafing pan, into said interior space for coupling said shell to the dish for covering the dish for protecting contents of the dish, such as from insects, germs, and temperature changes, said shell being substantially rectangularly box shaped, said top and said bottom of said shell being squarely shaped;

a penetration positioned through said top of said shell, said penetration being squarely shaped;

a lid hingedly coupled to said top of said shell, said lid being complementary to said penetration, said lid being substantially transparent, said lid being selectively couplable to said shell for closing said penetration, wherein said lid is positioned on said shell such that said lid is positioned for pivoting to an open configuration for accessing the contents of the dish through said penetration and for pivoting to a closed configuration for closing said penetration for protecting the contents of the dish, such as from the insects, the germs, and the temperature changes;

at least one hinge coupled to and extending between said lid and said shell;

a handle coupled to said lid, said handle being opposingly positioned relative to said at least one hinge, wherein said handle is positioned on said lid such that said handle is configured for grasping in a hand of a user for selectively motivating said lid between the open configuration and the closed configuration for opening and closing said penetration, said handle comprising a knob;

a plurality of slits positioned in said shell, wherein said slits are positioned in said shell such that said slits are configured for venting the dish, said plurality of slits comprising four said slits positioned singly in said top proximate to each corner edge of said shell;

a lip coupled to said shell and extending inwardly from said bottom;

a plurality of couplers coupled to said lip, said couplers being configured for coupling to the dish for coupling said shell to the dish, wherein said couplers are positioned on said lip such that said couplers are configured for coupling to the dish for coupling said shell to the dish, each said coupler comprising a tab coupled to and extending from said lip, said tabs being resilient, wherein said tabs are positioned on said lip such that said tabs are configured for bending when contacting a rim of the dish and for rebounding such that said tabs are positioned below the rim for coupling said shell to the dish, said plurality of couplers comprising four said couplers positioned singly between and substantially equally distant from adjacent said corner edges of said shell; and wherein said tabs are positioned on said lip such that said tabs are configured for bending when contacting the rim of the dish and for rebounding such that said tabs are positioned below the rim for coupling said shell to the dish for protecting the contents of the dish, such as from the insects, the germs, and the temperature changes, wherein said slits are positioned in said shell such that said slits are configured for venting the dish, wherein said knob is positioned on said lid such that said knob is configured for grasping in the hand of the user for selectively motivating said lid between the open configuration, for accessing the contents of the dish through said penetration, and the closed configuration, for closing said penetration for protecting the contents of the dish, such as from the insects, the germs, and the temperature changes.

* * * * *